US010127843B2

(12) United States Patent
Green

(10) Patent No.: US 10,127,843 B2
(45) Date of Patent: Nov. 13, 2018

(54) PHOTOLUMINESCENT SIGNAGE

(71) Applicant: Zachary L. Green, Cincinnati, OH (US)

(72) Inventor: Zachary L. Green, Cincinnati, OH (US)

(73) Assignee: EVP International, LLC, Cincinnati, OH (US)

( * ) Notice: Subject to any disclaimer, the term of this patent is extended or adjusted under 35 U.S.C. 154(b) by 0 days.

(21) Appl. No.: 15/320,859

(22) PCT Filed: Jun. 17, 2015

(86) PCT No.: PCT/US2015/036174
§ 371 (c)(1),
(2) Date: Dec. 21, 2016

(87) PCT Pub. No.: WO2016/010666
PCT Pub. Date: Jan. 21, 2016

(65) Prior Publication Data

US 2017/0206812 A1 Jul. 20, 2017

Related U.S. Application Data

(60) Provisional application No. 62/024,563, filed on Jul. 15, 2014.

(51) Int. Cl.
*G09F 13/20* (2006.01)

(52) U.S. Cl.
CPC ..... *G09F 13/20* (2013.01)

(58) Field of Classification Search
CPC ... G09F 13/20; G09F 2013/0459; G09F 13/04
USPC ..... 40/542
See application file for complete search history.

(56) References Cited

U.S. PATENT DOCUMENTS 633,450 A * 9/1899 Handlan ..... E01F 9/65 116/175
1,654,370 A * 12/1927 Goetschius ..... G09F 13/20 362/34
2,372,124 A * 3/1945 Schenkel ..... G09F 13/26 40/577

(Continued)

FOREIGN PATENT DOCUMENTS

CA 2771287 A1 9/2012
CN 201397644 Y 2/2010

(Continued)

OTHER PUBLICATIONS

Lukashina, E.; International Search Report and Written Opinion of the International Searching Authority, issued in International Application No. PCT/US2015/036174; dated Oct. 8, 2015; 8 pages.

(Continued)

*Primary Examiner* — Shin H Kim
(74) *Attorney, Agent, or Firm* — Ulmer & Berne LLP

(57) ABSTRACT

A non-powered photoluminescent sign includes a clear substrate and a message. The message is positioned on a surface of the clear substrate. The message is defined by at least one opaque portion. At least one of the at least one opaque portion is photoluminescent. The message is viewable with ambient light and without ambient light. Methods and other photoluminescent signs are also provided.

21 Claims, 7 Drawing Sheets

(56) References Cited

U.S. PATENT DOCUMENTS 2,383,884 A * 8/1945 Palmquist ..... G02B 5/128 359/538
2,387,512 A 10/1945 Hilberg
2,994,149 A * 8/1961 Endelson ..... G09F 13/02 362/223
3,176,420 A * 4/1965 Alverson ..... G02B 5/128 359/538
3,552,702 A * 1/1971 Springer ..... G09F 7/18 248/316.7
3,591,941 A * 7/1971 Jaffe, Jr. ..... F21V 23/00 40/546
4,016,665 A * 4/1977 Sakota ..... G09F 7/00 40/582
4,250,646 A * 2/1981 Trachtenberg ..... G09F 13/16 40/561
4,263,739 A * 4/1981 Lee ..... G09F 7/18 40/606.18
4,420,898 A * 12/1983 Moses ..... G08B 7/062 40/544
4,918,578 A * 4/1990 Thompson ..... F21V 15/04 362/634
5,009,019 A * 4/1991 Erlendsson ..... G09F 13/20 40/541
5,277,146 A * 1/1994 Hughes, Jr. ..... E01F 9/65 116/175
5,283,968 A * 2/1994 Williams ..... G02B 6/0043 40/546
5,355,117 A * 10/1994 Jefferson ..... B60Q 1/48 16/280
5,428,913 A * 7/1995 Hillstrom ..... G09F 7/18 40/604
5,536,558 A * 7/1996 Shelton ..... G09F 13/20 156/209
5,829,177 A * 11/1998 Hjaltason ..... G02B 6/0003 362/812
5,873,187 A * 2/1999 Kozak ..... E01F 9/524 40/542
5,904,017 A * 5/1999 Glatz ..... E04F 19/04 250/462.1
6,305,109 B1 * 10/2001 Lee ..... G02B 6/0068 40/546
6,475,586 B1 * 11/2002 Ikawa ..... B44C 1/105 40/442
6,493,973 B1 * 12/2002 Nelson ..... G09F 7/18 40/607.12
6,499,421 B1 * 12/2002 Honigsbaum ..... G09F 19/22 116/205
6,601,328 B1 * 8/2003 Benaquista ..... G09F 1/10 248/218.4
6,785,992 B2 * 9/2004 Chiarucci ..... G08B 7/062 40/596
6,843,010 B2 * 1/2005 Robinson ..... G09F 13/04 40/542
6,896,388 B2 * 5/2005 George ..... F21S 8/032 340/332
7,162,821 B2 * 1/2007 Venkataraman ..... G09F 13/04 40/541
7,412,790 B2 * 8/2008 Riopel ..... G02B 6/005 40/542
7,698,843 B2 * 4/2010 Hillstrom ..... G09F 15/0025 248/121
D625,363 S * 10/2010 Lee ..... D20/42
8,046,943 B2 11/2011 Kay
8,499,480 B2 * 8/2013 Schlasinger ..... G09F 7/04 40/600
8,836,212 B2 * 9/2014 Skipor ..... B41M 3/006 313/501
2004/0154199 A1 * 8/2004 Robinson ..... G09F 13/04 40/570
2004/0202812 A1 10/2004 Congard et al.
2004/0245764 A1 * 12/2004 Bolta ..... G09F 13/20 283/75
2005/0102871 A1 5/2005 Merle et al.
2005/0127263 A1 * 6/2005 Lemire ..... A47G 1/1613 248/475.1
2005/0198879 A1 9/2005 Hannington
2006/0080873 A1 * 4/2006 Riopel ..... G02B 6/005 40/546
2006/0096141 A1 5/2006 Presley et al.
2007/0240346 A1 * 10/2007 Li ..... G09F 13/20 40/544
2009/0229510 A1 * 9/2009 Sutter ..... G09F 13/16 116/209
2010/0018092 A1 1/2010 Peckham
2011/0239504 A1 * 10/2011 Keuning ..... G09F 7/00 40/584
2012/0124873 A1 * 5/2012 Lee ..... G09F 13/18 40/546
2012/0144710 A1 * 6/2012 Casterline ..... A47G 1/0655 40/745
2012/0233895 A1 9/2012 Martin et al.
2013/0019509 A1 * 1/2013 Smith ..... G09F 7/18 40/607.11
2013/0255118 A1 * 10/2013 Warren ..... G09F 13/0404 40/572
2016/0027266 A1 * 1/2016 Mc Donagh ..... G08B 7/062 340/815.4
2016/0216417 A1 * 7/2016 Cross ..... G09F 13/20
2017/0165997 A1 * 6/2017 Holmes ..... B42D 25/425

FOREIGN PATENT DOCUMENTS

RU 2533667 C2 11/2014
SU 1583965 A1 8/1990
WO 2004044875 A1 5/2004
WO 2009025566 A1 2/2009

OTHER PUBLICATIONS

Innova Solutions; Glo-Brite 520 Class B—photoluminescent laminating film product information; retrieved from http://innovasolutions.co.uk/products/photoluminescent/glo-brite-520 . . . on Jul. 4, 2014; 2 pages.
American Permalight Inc.; Main Catalog 2014, Photoluminescent Safety Products and Bumper Guards; published Jan. 2014; 20 pages.

* cited by examiner

WITH AMBIENT LIGHTING

WITH NO AMBIENT LIGHTING

PHOTOLUMINESCENT SIGNAGE

REFERENCE TO RELATED APPLICATION

This application claims priority of U.S. provisional patent application Ser. No. 62/024,563, filed Jul. 15, 2014, and hereby incorporates this provisional patent application by reference herein in its entirety.

TECHNICAL FIELD

Embodiments of the technology relate, in general, to photoluminescent signage having both clear portions and opaque portions, where the opaque portions convey a message. More particularly, embodiments of the technology relate to non-powered photoluminescent signage.

BACKGROUND

Various types of illuminated signs can be used for indicating location of safety equipment and other objects, showing directions for normal or emergency egress, and/or providing warnings. These signs can act as important safety measures, particularly during emergencies. Existing signs may require electricity or some other source of power to illuminate or display the information contained thereon. However, such conventional signs are deficient in several ways. For example, powered signage can be expensive to install and maintain. Additionally, should the power source be interrupted or otherwise fail to function, the sign may not adequately serve its purpose during emergency or non-emergency situations. Finally, the general aesthetics of the signage may be undesirable for a particular space or usage.

BRIEF DESCRIPTION OF THE DRAWINGS

It is believed that certain embodiments will be better understood from the following description taken in conjunction with the accompanying drawings, in which like references indicate similar elements and in which.

DETAILED DESCRIPTION

Figure 1:
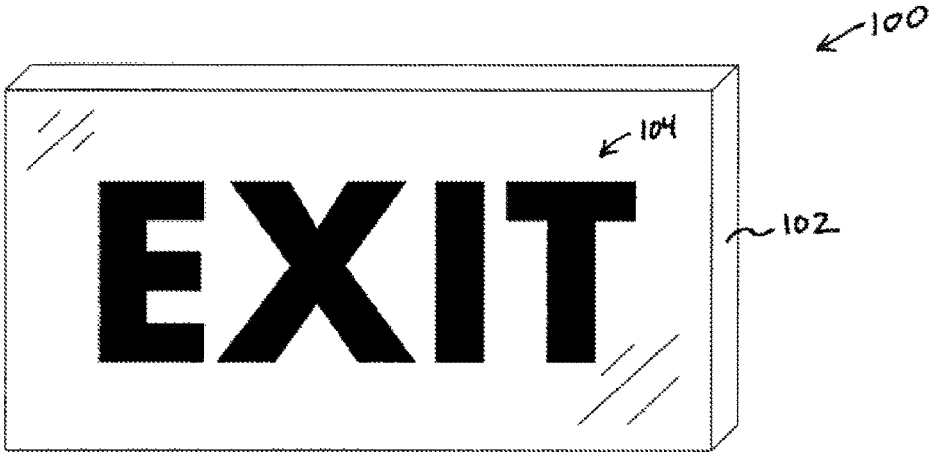
FIGS. 1-3 depict example photoluminescent signs in accordance with various non-limiting embodiments.

Various non-limiting embodiments of the present disclosure will now be described to provide an overall understanding of the principles of the structure, function, and use of photoluminescent signage disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Described herein are example embodiments of photoluminescent signage and methods of manufacture. The examples discussed herein are examples only and are provided to assist in the explanation of the apparatuses, devices, systems and methods described herein. None of the features or components shown in the drawings or discussed below should be taken as mandatory for any specific implementation of any of these apparatuses, devices, systems or methods unless specifically designated as mandatory. For ease of reading and clarity, certain components, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The present disclosure is generally directed to non-powered photoluminescent signs that do not utilize external or on-board power sources. As described in more detail below, the photoluminescent signs can have a generally clear substrate on which a message is applied. The message can comprise photoluminescent graphics, letters, or combinations thereof. The particular message can vary depending on application or use. Example messages can indicate points of egress, indicate location of objects (such as stairs, fire alarms, fires hoses, or fire extinguishers), or otherwise provide information to a viewer of the photoluminescent sign. Since the message is photoluminescent, it is viewable in situations where there is little to no ambient lighting, as may be experienced during an emergency event. In some embodiments, the only portion of the photoluminescent sign that is opaque is the message. In other embodiments, other portions of the photoluminescent sign besides the message can be opaque, such as points of attachment and other generally incidental portions. In some embodiments, the opaque portions of the photoluminescent signs are substantially photoluminescent. In some embodiments, the photoluminescent portions of the opaque portions are outlined by a border, such as a reflective border.

Figure 2:
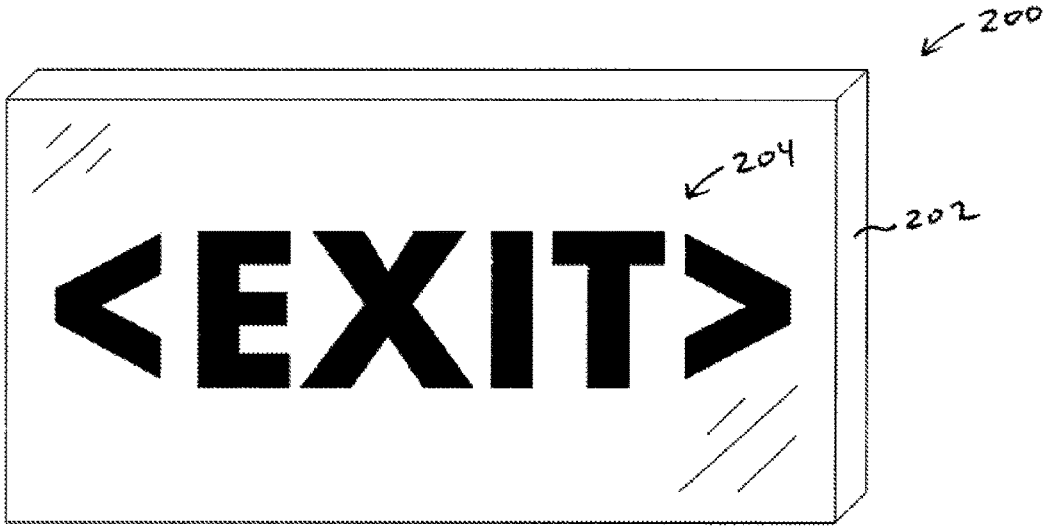
Figure 3:
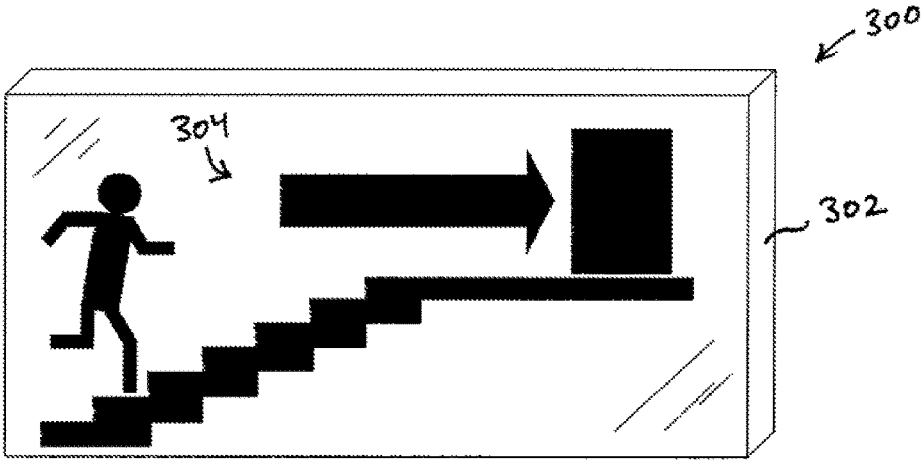

FIGS. 1-3 depict example photoluminescent signs in accordance with various non-limiting embodiments. As is to be appreciated, the particular font, size and layout of the photoluminescent signs described herein can vary based on application. Referring first to FIG. 1, a photoluminescent sign 100 has a transparent or clear substrate 102. The clear substrate 102 can be any suitable material that provides the desired rigidity and aesthetics, such as glass, plastic, acrylic, Plexiglas® or Lexan™, for example. The size of clear substrate 102 can be any suitable size. In some embodiments, the height of the clear substrate 102 can be in the range of about 6 inches to about 14 inches. In some embodiments, the width of the clear substrate 102 can be in the range of about 6 inches to about 14 inches. In some embodiments, the thickness of the clear substrate 102 can be in the range of about ⅛ inch to about ½ inch. The photoluminescent sign 100 also has a message 104 that is applied, printed or otherwise attached to the clear substrate 102. The size of the message 104 can depend, for example, on a desired visibility distance. In some embodiments, the message 104 is about 6 inches high. The message 104 can be positioned on either the front surface of the clear substrate 102 (as shown) or the rear surface of the clear substrate 102. The message 104 can be photoluminescent such that the message 104 is viewable in low-light conditions. The photoluminescent sign 100 has translucent portions and opaque portions. The opaque portions are defined by the message 104 and the translucent portions are defined by the portions of the clear substrate 102 that are not covered by the message 104.

The particular message delivered by the photoluminescent signage described herein can vary based on application. FIG. 2, for example, depicts an example embodiment of a photoluminescent sign 200 having a message 204 that comprises both text and graphics. The photoluminescent sign 200 is generally similar to the photoluminescent sign 100 and has a clear substrate 202. The example message 204 depicted in FIG. 2 includes directional arrows in addition to text. FIG. 3 depicts an example embodiment of a photoluminescent sign 300 that has a non-text message 304. Similar to FIG. 1 and FIG. 2, the photoluminescent sign 300 has a clear substrate 302 on which the message 304 is applied.

Figure 4:
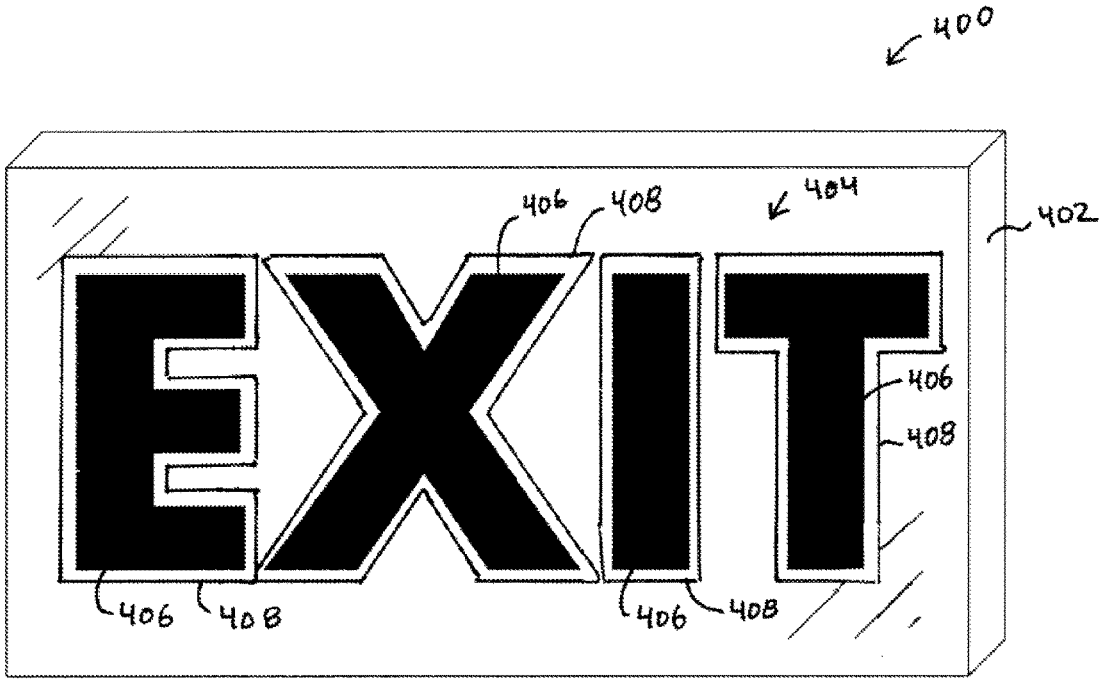
FIG. 4 depicts an example photoluminescent sign having a message that is applied to the clear substrate.

In some embodiments the entire message is photoluminescent, while in other embodiments a portion of the message is photoluminescent and the remaining portion of the message is opaque. FIG. 4 depicts an example photoluminescent sign 400 having a message 404 that is applied to the clear substrate 402. The message 404 includes a photoluminescent portion 406 and an opaque portion 408 that is not photoluminescent. In the illustrated embodiment, the opaque portion 408 is a border around each letter in the message. As is to be appreciated, similar opaque portions can also border graphical elements, such as directional arrows, stairs, and the like. In some embodiments the opaque portion 408 comprises a reflective material to aid in visibility. For example, the opaque portion 408 can be colored reflective film, such as a red or green film. In other embodiments, the opaque portion 408 can be white, black, or any other suitable color. The particular thickness of the opaque portion 408 relative to the photoluminescent portion 406 can vary. As depicted in FIG. 4, in some embodiments, the photoluminescent portion 406 can dominate the visual impression of the message. In some embodiments, the border portions of the message can be photoluminescent and the interior portions of the message can be non-photoluminescent.

Figure 5:
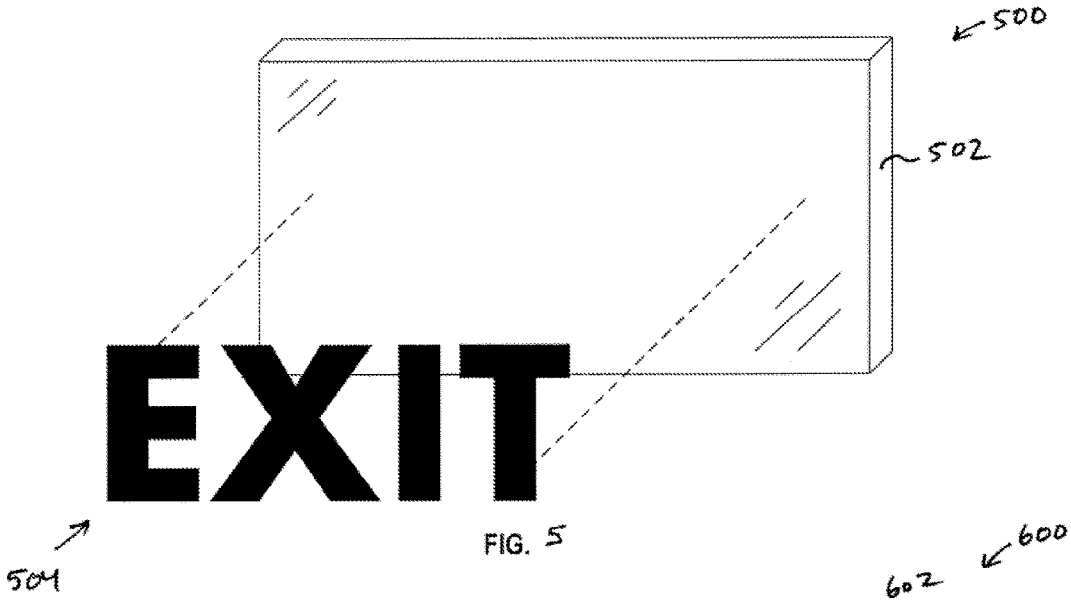
FIGS. 5 and 6 depict exploded views of example photoluminescent signs.
Figure 6:
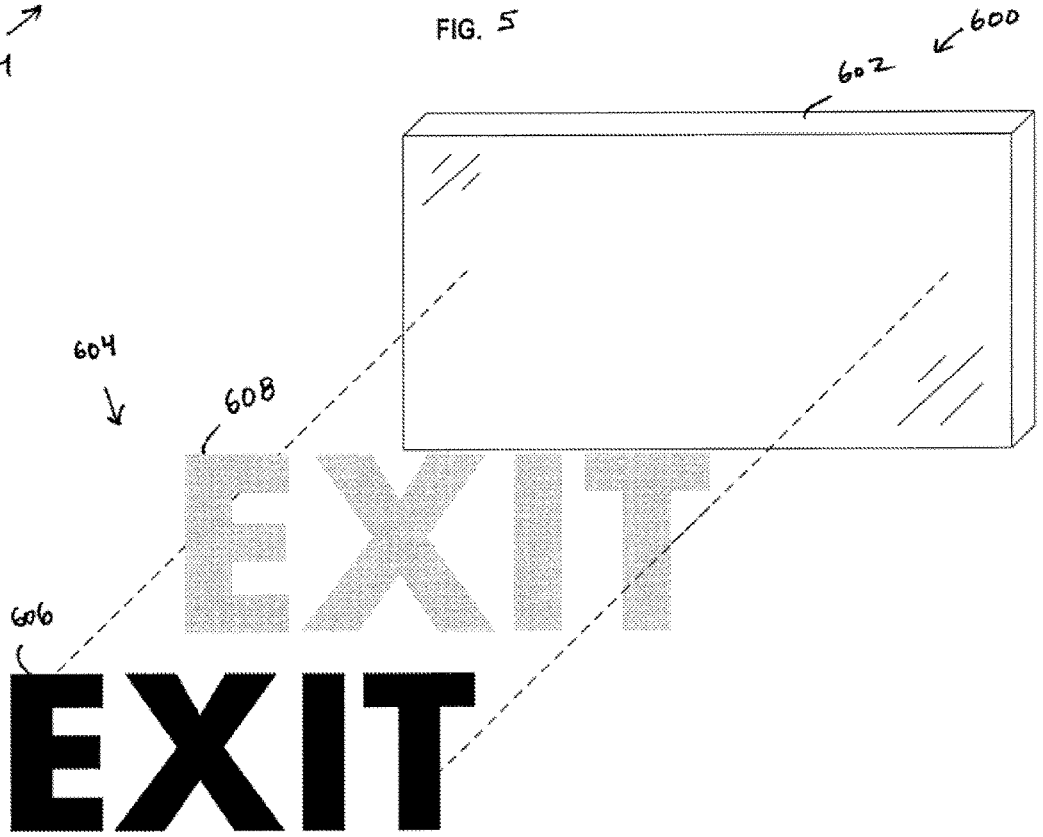

FIGS. 5 and 6 depict exploded views of example photoluminescent signs. The photoluminescent sign 500 has a message 504 that is entirely photoluminescent whereas the photoluminescent sign 600 has a message 604 that comprises both photoluminescent portions 606 and opaque portions 608. Referring first to FIG. 5, the letters of the message 504 are a vinyl-type film that is infused with photoluminescent pigment. During manufacturing, the letters of the message 504 are applied to the clear substrate 502 using any suitable adhesive or bonding agent. In some embodiments, pressure can be applied to the letters of message 504 using a roller or other technique to remove air bubbles and wrinkles. Referring now to FIG. 6, the letters of opaque portion 608 of the message 604 can be sized to be larger than the photoluminescent portions 606 of the message. In one embodiment, the photoluminescent portions 606 can be joined with the opaque portions 608 and then the assembly is applied to the clear substrate 602. In another embodiment, the opaque portions 608 are first applied to the clear substrate 602 and then the photoluminescent portions 606 are subsequently applied to the clear substrate 602 such that they overlay the opaque portions 608.

Figure 7:
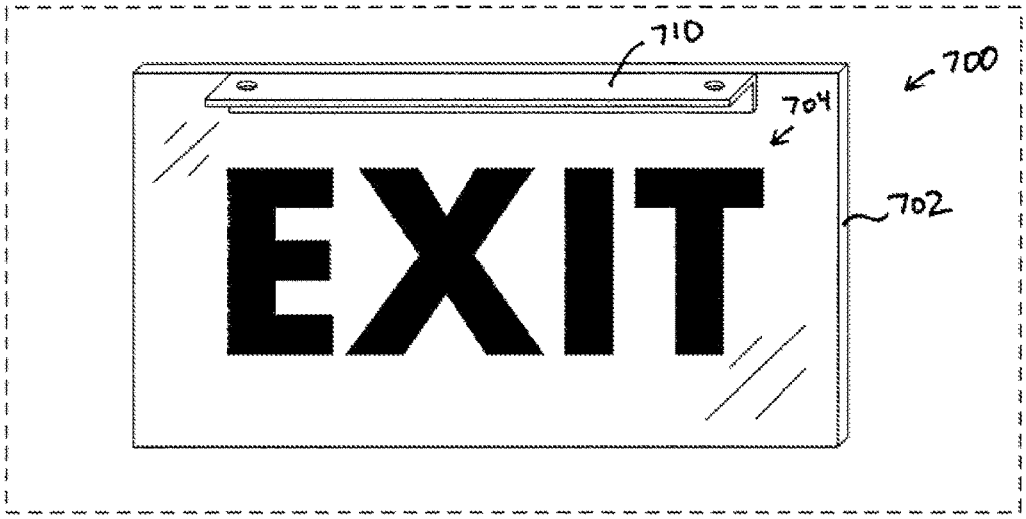
FIG. 7 depicts an example photoluminescent sign positioned in an environment having sufficient ambient lighting.
Figure 8:
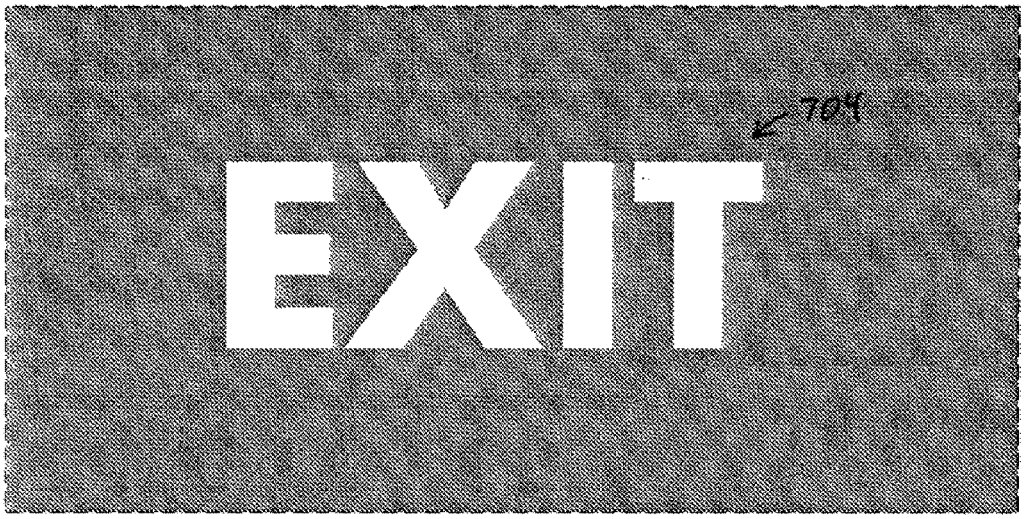
FIG. 8 depicts the photoluminescent sign of FIG. 7 with no ambient lighting.

FIG. 7 depicts an example photoluminescent sign 700 positioned in an environment having sufficient ambient lighting. The photoluminescent sign 700 has a mounting bracket 710 to assist with securing the photoluminescent sign 700 to a structure. Other types of mounting brackets or fixtures can be used. FIG. 8 depicts the photoluminescent sign 700 with no ambient lighting. As shown, the message 704 is viewable due to its photoluminescence.

Figure 9:
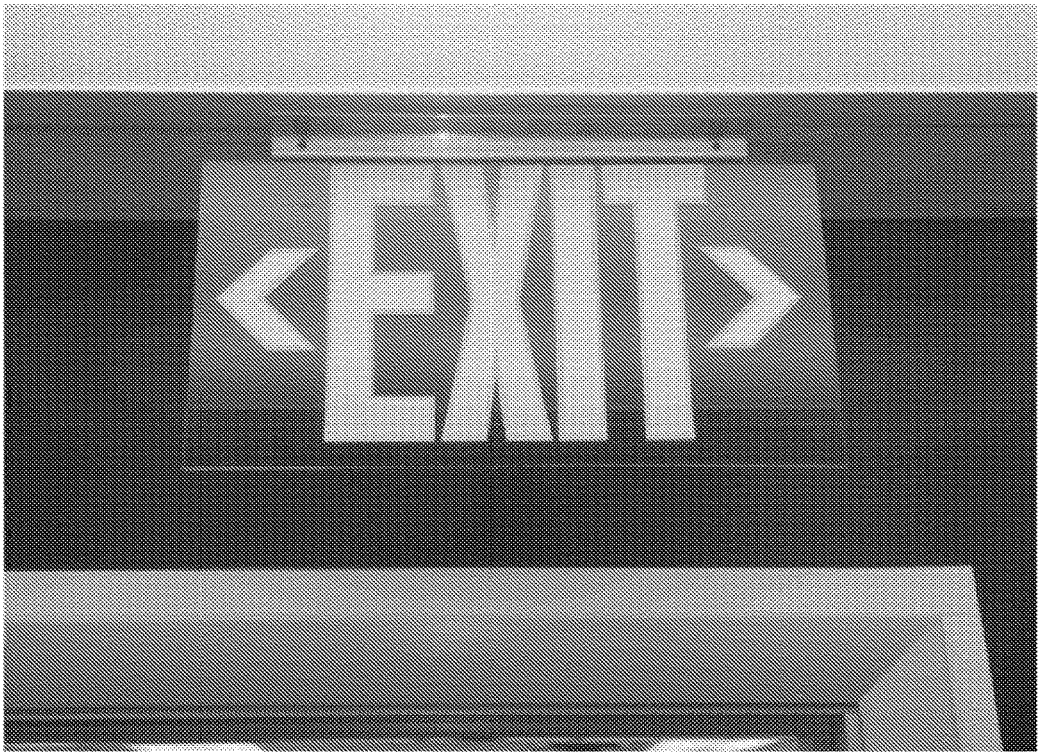
FIGS. 9-11 show an example photoluminescent sign in accordance with the present disclosure.
Figure 10:
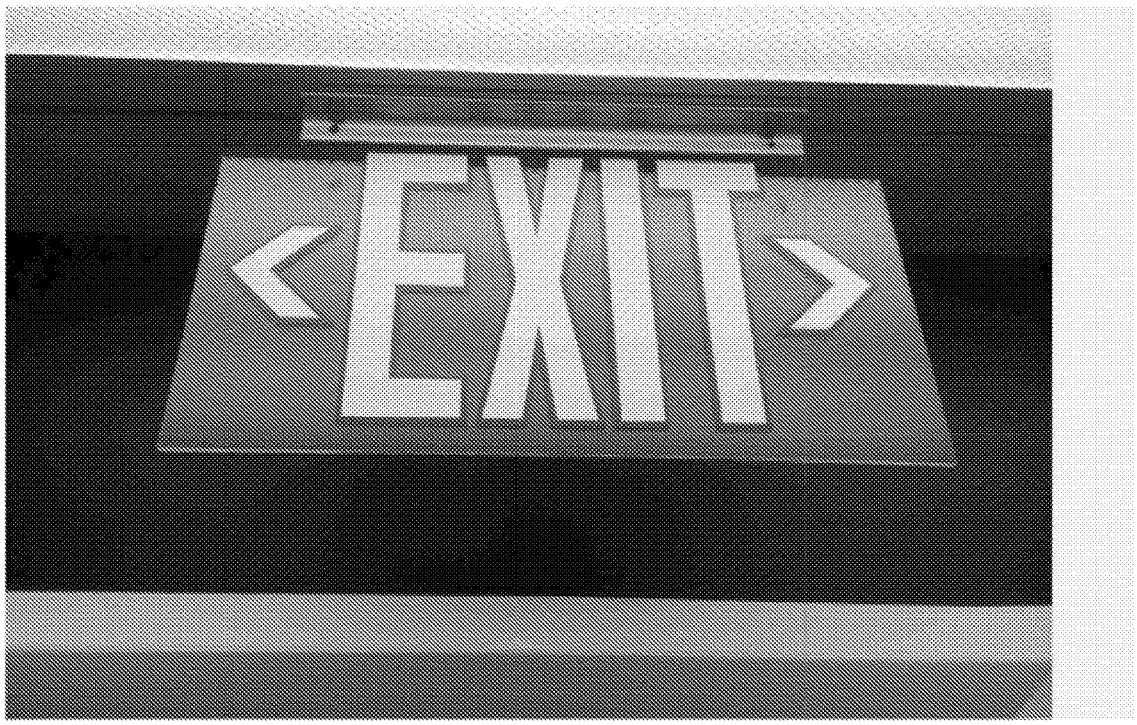
Figure 11:
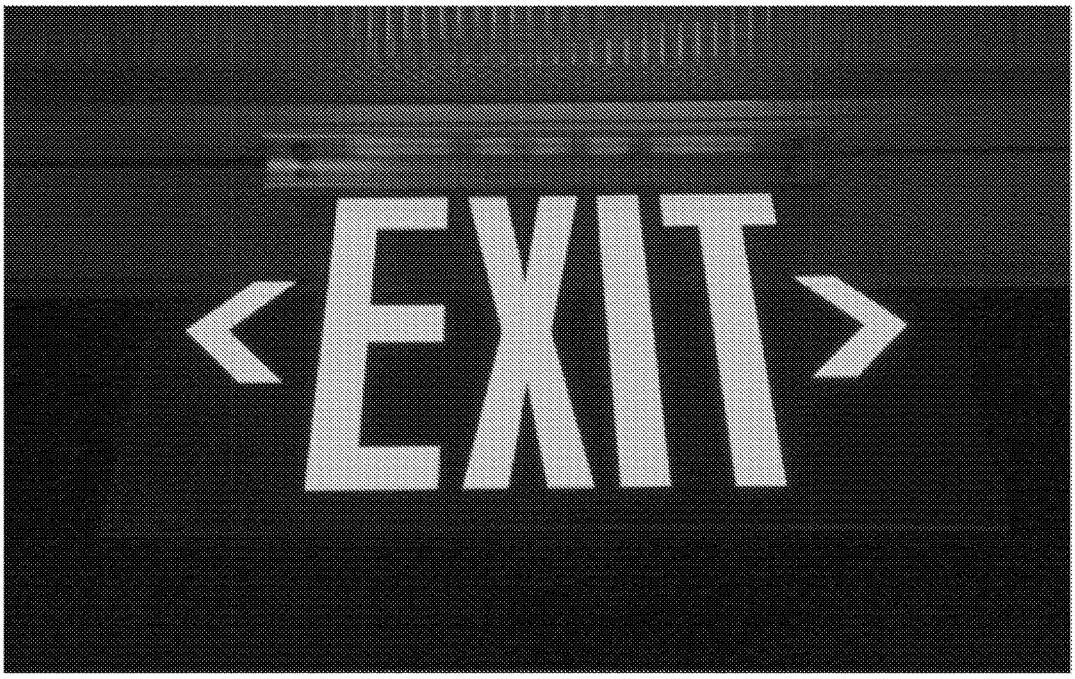

FIGS. 9-11 show an example photoluminescent sign in accordance with the present disclosure. FIGS. 9-10 depict the photoluminescent sign having a green reflective border around photoluminescent letters. FIG. 11 depicts the photoluminescent sign in a low light condition.

These and other embodiments of the systems and methods can be used as would be recognized by those skilled in the art. The above descriptions of various systems and methods are intended to illustrate specific examples and describe certain ways of making and using the systems disclosed and described here. These descriptions are neither intended to be nor should be taken as an exhaustive list of the possible ways in which these systems can be made and used. A number of modifications, including substitutions of systems between or among examples and variations among combinations can be made. Those modifications and variations should be apparent to those of ordinary skill in this area after having read this disclosure.

The invention claimed is:

1. An exit sign comprising:

a clear substrate comprising a front surface and a rear surface, wherein the front surface of the clear substrate is substantially smooth;

a first letter having a shape of an E;

a second letter having a shape of an X;

a third letter having a shape of an I; and a fourth letter having a shape of an T; wherein the first letter, the second letter, the third letter, and the fourth letter are each spaced from one another and arranged relative one another to provide an EXIT message; and with respect to each of the first letter, the second letter, the third letter, and the fourth letter:

the letter comprises a reflective layer and a photoluminescent layer;

a rear surface of the reflective layer adheres to the front surface of the clear substrate;

a rear surface of the photoluminescent layer adheres to a front surface of the reflective layer, such that a portion of the reflective layer is sandwiched between the photoluminescent layer and the clear substrate;

each of the reflective layer and the photoluminescent layer is shaped to correspond with the shape of the letter;

the reflective layer is larger than the photoluminescent layer such that the reflective layer provides a border circumscribing the photoluminescent layer; an-GI a face of the letter is defined through cooperation of the front surface of the photoluminescent layer and the border provided by the reflective layer;

the photoluminescent layer facilitates visibility and readability of the letter without ambient light; and the reflective layer facilitates visibility and readability of the letter in ambient light; and wherein the exit sign is not connected to an electric power source.

2. The exit sign of claim 1, wherein the clear substrate comprises a rigid sheet.

3. The exit sign of claim 2, wherein the rigid sheet is formed from plastic.

4. The exit sign of claim 3, wherein the reflective layer is colored red or green.

5. The exit sign of claim 3, wherein portions of the clear substrate not covered with the reflective layer facilitate visibility through the clear substrate in ambient light of environment of the non-powered exit sign.

6. The exit sign of claim 3, wherein portions of the clear substrate not covered with the reflective layer facilitate frontal visibility through the clear substrate in ambient light of environment rearward of the non-powered exit sign.

7. The exit sign of claim 4, wherein the clear substrate has a height in the range of about 6 inches to about 14 inches and the EXIT message has a height of about 7 inches.

8. The exit sign of claim 6, further comprising a mounting bracket, wherein:

the mounting bracket defines a first set of apertures and a second set of apertures;

the first set of apertures is configured for receiving fasteners extending in a first direction to facilitate attachment of the clear substrate to the mounting bracket; and the second set of apertures is configured for receiving fasteners extending in a second direction to facilitate attachment of the mounting bracket to a wall or ceiling structure.

9. The exit sign of claim 8, wherein the first direction is transverse to the second direction.

10. The exit sign of claim 1, further comprising a mounting bracket, wherein:

the mounting bracket defines a first set of apertures and a second set of apertures;

the first set of apertures is configured for receiving fasteners extending in a first direction to facilitate attachment of the clear substrate to the mounting bracket; and the second set of apertures is configured for receiving fasteners extending in a second direction to facilitate attachment of the mounting bracket to a wall or ceiling structure.

11. The exit sign of claim 10, wherein the first direction is transverse to the second direction.

12. A photoluminescent exit sign comprising:

a substrate having a front surface and a rear surface, wherein the front surface of the clear substrate is substantially smooth; and a message comprising a plurality of multi-layered letters, wherein each of the multi-layered letters comprises:

an upper photoluminescent layer, wherein the upper photoluminescent layer facilitates visibility and readability of the letter without ambient light; and a lower colored layer, wherein the lower colored layer facilitates visibility and readability of the letter with ambient light;

wherein the upper photoluminescent layer overlaps and is adhered to the lower colored layer;

wherein the lower colored layer comprises a first portion overlapped by the upper photoluminescent layer and a second portion not overlapped by the upper photoluminescent layer;

wherein the second portion forms a colored border around a periphery of each letter, and wherein the exit sign is not connected to an electric power source.

13. The photoluminescent exit sign of claim 12, wherein a rear surface of the lower colored layer is adhered to the front surface of the substrate.

14. The photoluminescent exit sign of claim 12, wherein the substrate is clear, and wherein a front surface of the upper photoluminescent layer is adhered to the rear surface of the substrate.

15. The photoluminescent exit sign of claim 12, wherein the message further comprises a multi-layered graphic, the multi-layered graphic comprising:

an upper photoluminescent graphic layer; and a lower colored graphic layer;

wherein the upper photoluminescent graphic layer overlaps and is adhered to the lower colored graphic layer;

wherein the lower colored graphic layer comprises a first graphic portion overlapped by the upper photoluminescent graphic layer and a second graphic portion not overlapped by the upper photoluminescent graphic layer; and wherein the second graphic portion forms a colored border around a periphery of the graphic.

16. The photoluminescent exit sign of claim 15, wherein a rear surface of the lower colored graphic layer is adhered to the front surface of the substrate.

17. The photoluminescent exit sign of claim 15, wherein the substrate is clear, and wherein a front surface of the upper photoluminescent graphic layer is adhered to the rear surface of the substrate.

18. The photoluminescent exit sign of claim 12, further comprising:

a mounting bracket, wherein:

the mounting bracket defines a first set of apertures and a second set of apertures;

the first set of apertures is configured for receiving fasteners extending in a first direction to facilitate attachment of the substrate to the mounting bracket; and the second set of apertures is configured for receiving fasteners extending in a second direction to facilitate attachment of the mounting bracket to a wall or ceiling structure.

19. A photoluminescent exit sign comprising:

a clear substrate having a front surface and a rear surface, wherein the front surface of the clear substrate is substantially smooth; and a message positioned on the clear substrate, the message comprising a plurality of opaque letters, wherein the plurality of letters comprises a letter E, a letter X, a letter I, and a letter T;

wherein each of the letters has a front face comprising a first portion outlined by a second portion, wherein the first portion is photoluminescent and the second portion is reflective;

wherein the first portion is the shape of the respective letter;

wherein the second portion is the shape of the respective letter;

wherein the first portion has a first front surface and a first rear surface;

wherein the second portion has a second front surface and a second rear surface;

wherein at least a portion of the first rear surface is adhered to at least a portion of the second front surface;

wherein the message is viewable with ambient light and without ambient light; and wherein the exit sign is not connected to an electric power source.

20. The photoluminescent exit sign of claim 19, wherein the second rear surface is adhered to the front surface of the clear substrate.

21. The photoluminescent exit sign of claim 19, wherein the first front surface is adhered to the rear surface of the clear substrate.

* * * * *